United States Patent [19]

Covino

[11] Patent Number: 5,035,756

[45] Date of Patent: Jul. 30, 1991

[54] BONDING AGENTS FOR THERMITE COMPOSITIONS

[75] Inventor: Josephine Covino, Ridgecrest, Calif.

[73] Assignee: United States of America as represented by the Secretary of the Navy, Washington, D.C.

[21] Appl. No.: 296,162

[22] Filed: Jan. 10, 1989

[51] Int. Cl.[5] ..... C06B 33/00

[52] U.S. Cl. ..... 149/37; 149/45; 149/108.6; 149/114; 102/302

[58] Field of Search ..... 149/37, 45, 108.6, 1 A; 102/302

[56] References Cited

U.S. PATENT DOCUMENTS

| | | | |
|---|---|---|---|
| 1,318,709 | 10/1919 | Vautin | 149/37 |
| 3,086,876 | 4/1963 | Griggs et al. | 149/37 |
| 3,132,061 | 5/1964 | Walsh et al. | 149/41 |
| 3,437,534 | 4/1969 | McEwan et al. | 149/30 |
| 3,498,857 | 3/1970 | Lehikoinen | 149/21 |
| 3,649,390 | 3/1972 | Ahlert et al. | 149/37 |
| 3,745,077 | 7/1973 | Jones | 149/40 |
| 4,129,465 | 12/1978 | Johnson et al. | 149/19.3 |
| 4,432,816 | 2/1984 | Kennedy et al. | 149/19.3 |
| 4,478,151 | 10/1984 | Vetter et al. | 102/481 |
| 4,536,237 | 8/1985 | Kachik | 149/37 |

*Primary Examiner*—Peter A. Nelson

*Attorney, Agent, or Firm*—Melvin J. Sliwka; Donald E. Lincoln; Stuart H. Nissim

[57] ABSTRACT

A thermite mixture with a low autoignition temperature for venting ordnance case sidewalls during fuel fire, having increased density, tensile strength and elasticity.

9 Claims, No Drawings

BONDING AGENTS FOR THERMITE COMPOSITIONS

BACKGROUND OF THE INVENTION

1. Field of the Invention

The present invention relates generally to fuels for the production of heat. More particularly this invention relates to an aluminothermic reaction mixture consisting essentially of aluminum, iron oxide and a bonding agent selected to lower the ignition temperature of pressed thermite pellets.

2. Description of the Prior Art

In aviation fuel fires that engulf military aircraft, a primary source of damage and spreading of fire is the violent detonation of bombs, warheads, and rocket motors. Devices containing thermite mixtures have been used to breech the case sidewalls when exposed to fuel fires to prevent excessive pressure and explosions, by burning vent-holes in the side of the ordnance and allowing the propellant to vent-off through the resulting holes rather than allowing the ordnance to detonate. For this and similar applications, the thermite mixtures must be pressed into a useful shape such as a pellet and attached to the case walls of the ordnance. Pellets pressed from conventional thermite mixtures have an autoignition temperature that is too high for quick response to an aviation fuel fire. Sometimes the propellants in the ordnance will explode before the thermite has ignited and vented the case sidewall. Additionally conventional thermite mixtures have low tensile strength. Low tensile strength is undesirable for pellets subjected to thermal cycling over the designed operating temperature range of the ordnance. The physical properties of thermite pellets, however, can be enhanced by compacting the pellets in fabricated metal sponge or by the addition of fluorocarbon polymers to the mixture. The major drawback of these techniques is they are too costly.

OBJECTS OF THE INVENTION

It is an object of this invention to provide a mixture for use in melting and venting ordnance case sidewalls before the motor propellant grain autoignites in response to a fuel fire.

It is a further object of this invention to provide a mixture that has an autoignition temperature above the maximum temperature expected at the motor sidewall during normal operation while assuring proper autoignition and subsequent case sidewall melting and venting before the motor propellant detonates in response to the heat of fuel fires.

It is a further object of this invention to provide a simple, low cost mixture for increasing the density, tensile strength and elasticity of pressed thermite pellets.

SUMMARY OF THE INVENTION

This invention provides an aluminothermic mixture having a predetermined temperature of autoignition lower than the temperature of ignition of the rocket propellant so that it will ignite during aircraft fuel fire while remaining stable during normal operating temperature of the rocket propellant, being very energetic, having high elasticity and tensile strength, and having improved density when pressed into a desired shape.

DESCRIPTION OF THE INVENTION

The starting material is the conventional thermite mixture, having the following general formula by weight percent:

| Ingredients: | Percent by weight |
|---|---|
| $Fe_2O_3$ (less than 1 micron particle size) | 75 |
| H-3 Aluminum (3 microns particle size) | 4 |
| H-60 Aluminum (60 microns particle size) | 21 |

To this mixture, a bonding agent, such as Potassium Bromide (KBr), Sodium Bromide (NaBr), Calcium Bromide (CaBr), Sulfur, or compounds of Sulfur, (approximately 5 microns particle size), is added in an amount between 5% and 8% by weight. Pellets are then pressed from the resulting mixture in a conventional manner. The resulting pellets have temperatures of autoignition in the range of 300° to 500° F., substantially improved tensile strength, density and elasticity.

The following examples are given to illustrate the invention but are not intended to limit the generally broad scope thereof.

EXAMPLE

The bonding agent and thermite ingredients were first prepared for use. The bonding agents, ground sublimed Sulfur (reagent grade) was used as supplied, but the Potassium Bromide (KBr) (reagent grade) was dried in a vacuum oven at 60° C., for 12 hours. The thermite ingredients, aluminum and iron oxide, were dried in a vacuum oven at 80° C., from about 12 to 24 hours.

The components were then weighed and ground together with a mortar and pestle until uniform mixing was obtained and then formed into pellets under pressure from 7,000 to 10,000 psi at room temperature, into 3.89 mm thick by 1-inch diameter disk shaped pellets. The pellets, weighing from 3.2–3.8 g, were pressed to 95% of theoretical density.

The following combination of mixtures exhibited self-ignition in about 10.8 seconds at the desired temperature range from about 300° to about 500° F. and showed an increase in tensile strength and a decrease in brittleness over the prior art:

| Ingredient: | Percent by weight |
|---|---|
| Admixture 1 | |
| $Fe_2O_3$ (<1 micron) | 70.7 |
| H-3 Aluminum (3 microns) | 3.8 |
| H-60 Aluminum (60 microns) | 20.2 |
| KBr (approx. 5 microns) | 5.3 |
| Admixture 2 | |
| $Fe_2O_3$ (<1 micron) | 69.1 |
| H-3 Aluminum (3 microns) | 3.7 |
| H-60 Aluminum (60 microns) | 19.7 |
| KBr (approx. 5 microns) | 7.5 |
| Admixture 3 | |
| $Fe_2O_3$ (<1 micron) | 70.7 |
| H-3 Aluminum (3 microns) | 3.7 |
| H-60 Aluminum (60 microns) | 20.1 |
| Sulfur (approx. 5 microns) | 5.5 |

Potassium Bromide and Sulfur were selected for use as bonding agents to hold the ingredients together and as catalysts to ignite the thermite at lower temperatures and burn more energetically. The particular concentrations were arrived at through experimentation to obtain optimum burn-through penetration of a one-quarter inch steel plate at a temperature range from 300°–500° F., in about ten seconds. The pellets are layered, overlapping one-another by about one-third of their diameter to promote better ignition transmission from one pellet to another.

It will be obvious to those skilled in the art that many modifications may be made within the scope of the present invention without departing from the spirit thereof, and the invention includes all such modifications.

What is claimed is:

1. A mixture having thermic reaction properties for use in venting ordnance case walls during aviation fuel fires, comprising:

a mixture of aluminum powders in the range of H-3 to H-60;

an oxide of iron powder; and a bonding agent that ignites the mixture at low temperature.

2. The mixture of claim 1 wherein said bonding agent ignition temperature is from about 300° to 500° F.

3. The mixture of claim 1 wherein said bonding agent is selected from the group consisting of Sulfur and compounds of Sulfur.

4. The mixture of claim 1 wherein said bonding agent is selected from the group consisting of Potassium Bromide, Sodium Bromide and Calcium Bromide.

5. The mixture of claim 1 wherein said bonding agent comprises from about 5–8% by weight of the mixture.

6. A solid thermic reaction mixture for use in venting rocket motors during aviation fuel fire consisting essentially of:

from about 3.5 to 4.5 percent by weight H-3 aluminum, having a particle size of about 3 microns;

from about 19.0 to 22.0 percent by weight H-60 aluminum, having a particle size of about 60 microns;

from about 69.0 to 71.0 percent by weight $Fe_2O_3$, having a particle size of less than about 1 micron; and from about 5.0 to 8.0 percent by weight of a bonding agent, having a particle size of about 5 microns, wherein said bonding agent is selected from the group consisting of Sulfur and compounds of Sulfur and all said ingredients ground together to ensure all are finely dispersed and then pressed into pellets.

7. A mixture having thermic reaction properties for use in venting ordnance case walls during aviation fuel fire, the mixture comprising:

a mixture of aluminum powders in the range of H-3 to H-60;

an oxide of iron powder; and a bonding agent that ignites the mixture at temperatures from about 300° to 500° F., wherein said bonding agent is selected from the group consisting of Sulfur and compounds of Sulfur.

8. A mixture having thermic reaction properties for use in venting ordnance case walls during aviation fuel fire, the mixture comprising:

a mixture of aluminum powders in the range of H-3 to H-60;

an oxide of iron powder; and a bonding agent that ignites the mixture at temperatures from about 300° to 500° F., wherein said bonding agent is selected from the group consisting of Potassium Bromide, Sodium Bromide and Calcium Bromide.

9. A solid thermic reaction mixture for use in venting rocket motors during aviation fuel fire consisting essentially of:

from about 3.5 to 4.5 percent by weight H-3 aluminum, having a particle size of about 3 microns;

from about 19.0 to 22.0 percent by weight H-60 aluminum, having a particle size of about 60 microns;

from about 69.0 to 71.0 percent by weight $Fe_2O_3$, having a particle size of less than about 1 micron; and from about 5.0 to 8.0 percent by weight of a bonding agent, having a particle size of about 5 microns, wherein said bonding agent is selected from the group consisting of Potassium Bromide, Sodium Bromide and Calcium Bromide and all said ingredients ground together to ensure all are finely dispersed and then pressed into pellets.

* * * * *